US005638106A

United States Patent [19]

Nierescher

[11] Patent Number: 5,638,106

[45] Date of Patent: Jun. 10, 1997

[54] METHOD AND APPARATUS FOR ADJUSTING A PRINTHEAD

[75] Inventor: David S. Nierescher, Renton, Wash.

[73] Assignee: Intermec Corporation, Everett, Wash.

[21] Appl. No.: 526,541

[22] Filed: Sep. 11, 1995

Related U.S. Application Data

[63] Continuation of Ser. No. 983,662, Dec. 1, 1992, abandoned.

[51] Int. Cl.[6] ..... B41J 25/312

[52] U.S. Cl. ..... 347/198

[58] Field of Search ..... 347/197, 198; 400/120.16, 120.17

[56] References Cited

U.S. PATENT DOCUMENTS

| | | | |
|---|---|---|---|
| 4,775,870 | 10/1988 | Grimm et al. | 346/145 |
| 4,879,566 | 11/1989 | Hanabusa | 346/76 PH |
| 4,897,670 | 1/1990 | Hasegawa et al. | 346/76 PH |
| 5,206,662 | 4/1993 | Fox et al. | 346/76 PH |

*Primary Examiner*—Huan H. Tran
*Attorney, Agent, or Firm*—Seed and Berry LLP

[57] ABSTRACT

A method and apparatus for adjusting a printhead. The position of a thermal printhead for printing on a print medium that passes between the printhead and a print medium support member can be adjusted relative to the print medium support member. The adjustment is accomplished by adjusting the position of a shaft, attached to a printhead heat sink and passing through a printhead support member, relative to the printhead support member. The adjustment mechanism, placed at the end of the shaft passing through the printhead support member, includes a lever that can be adjusted rotationally with respect to the axis of the shaft. In one embodiment, the lever has a series of wedging surfaces of differing longitudinal thickness which engage a fastener near the end of the shaft. In another embodiment, the adjustment mechanism includes two levers, each having a series of wedging surfaces, but the longitudinal thicknesses of the wedging surface on one of the levers is greater than the thickness of any of the wedging surfaces on the other lever. The two levers interact with one another, with the printhead support member, and with the fastener on the shaft to provide for coarse and fine adjustments of the printhead position relative to the print medium support member. The spacing between the printhead support member and the printhead heat sink is adjusted by a compliant washer.

24 Claims, 5 Drawing Sheets

METHOD AND APPARATUS FOR ADJUSTING A PRINTHEAD

CROSS-REFERENCE TO RELATED APPLICATION

This application is a continuation of U.S. patent application No. 07/983,662, filed Dec. 1, 1992, now abandoned.

TECHNICAL FIELD

The present invention relates to thermal printheads, and more particularly to a method and apparatus for adjusting a thermal printhead.

BACKGROUND OF THE INVENTION

A thermal printer operates by sequentially heating desired patterns of small discrete areas ("pixels") of a thermal medium to produce desired light and dark patterns on the thermal medium. In some instances, the thermal medium can be a thermally sensitive medium which is heated directly, while in other instances, the thermal medium can be a thermal transfer ribbon which is heated to cause a small amount of dyed wax to be transferred to a medium which is not thermally sensitive.

The discrete areas of the thermal medium are heated by a thermal printhead which includes an array of minute, closely spaced resistive dots (or thermal print elements) that can be individually thermally controlled by means of electrical signals. The thermal medium is stepped past the printhead as each desired linear pattern is printed.

To maintain high print quality under all of the possible operating conditions, it is necessary to keep the spacing between the print medium and the printing elements in the printhead very well controlled. If the distance between the print medium and the printhead is too small, the print will be too dark. If the distance between the print medium and the printhead is too large, the print will be too light. If the distance between the print medium and the printhead varies during a printing session, the print darkness will be unacceptably variable.

At present, the spacing between the print medium and the printhead can be adjusted by means of Allen screws or shims. These devices can adjust the spacing between the printhead and the structure of the printer that holds the printhead against the print medium. However, using these mechanisms to adjust the printhead spacing is clumsy, requires special tools (such as an Allen wrench), and makes it difficult to reproduce the printhead spacing which is found to work with a particular print medium.

One particular circumstance under which the ability to make proper and reproducible adjustments of the spacing between the print medium and the printhead is when the printhead must be replaced in the field.

It is therefore desirable to be able to adjust the spacing between the printhead and the print medium in a thermal printer in a convenient and reproducible manner.

It is further desirable to be able to determine the amount of adjustment which the spacing between the printhead and the print medium has experienced.

SUMMARY OF THE INVENTION

According to one aspect, the invention is an adjustment mechanism for a printhead that prints on a print medium that passes between the printhead and a print medium support member. The adjustment mechanism comprises a printhead support member, a biasing member and an adjusting means. The printhead support member can be movably placed in a fixed position relative to the print medium support member. The biasing member is attached to the printhead support member and produces a biasing force relative to the print medium support member. The adjusting means acts upon the printhead support member and the biasing member to adjust the biasing force and cause the biasing force to move the printhead with respect to the printhead support member.

According to another aspect, the invention is an adjustment mechanism for adjusting a thermal printer having a thermal printhead and a print medium support member. The thermal printhead forms indicia on a print medium that passes adjacent the printhead in a predetermined direction and the print medium support member supports the print medium in the vicinity of the printhead. The adjustment mechanism comprises a printhead carrier and a printhead movement drive mechanism. The printhead carrier supports the printhead and directs the printhead to a position along a trajectory that is tangential to the print medium support member in the predetermined direction. The printhead movement drive mechanism adjusts the position of the printhead carrier along the trajectory.

According to a further aspect, the invention is a method for adjusting a printhead that prints on a print medium that passes between the printhead and a print medium support member. The method comprises the steps of a) placing a printhead support member in a fixed position relative to the print medium support member, and b) producing a variable biasing force on the printhead toward the print medium support member.

According to a still further aspect, the invention is a method for making adjustments to the position of a thermal printhead in a thermal printer having a thermal printhead and a print medium support member. The position of the thermal printhead is along a path that is tangential to the print medium support member. The method comprises the steps of a) providing a single indexing marker having sequential adjustment points, the adjustment points corresponding to positions of the printhead along the path to which the controller is capable of adjusting the printhead, and b) indicating the adjustment point of the printhead to a user of the thermal printer.

DETAILED DESCRIPTION OF THE INVENTION

Figure 1:
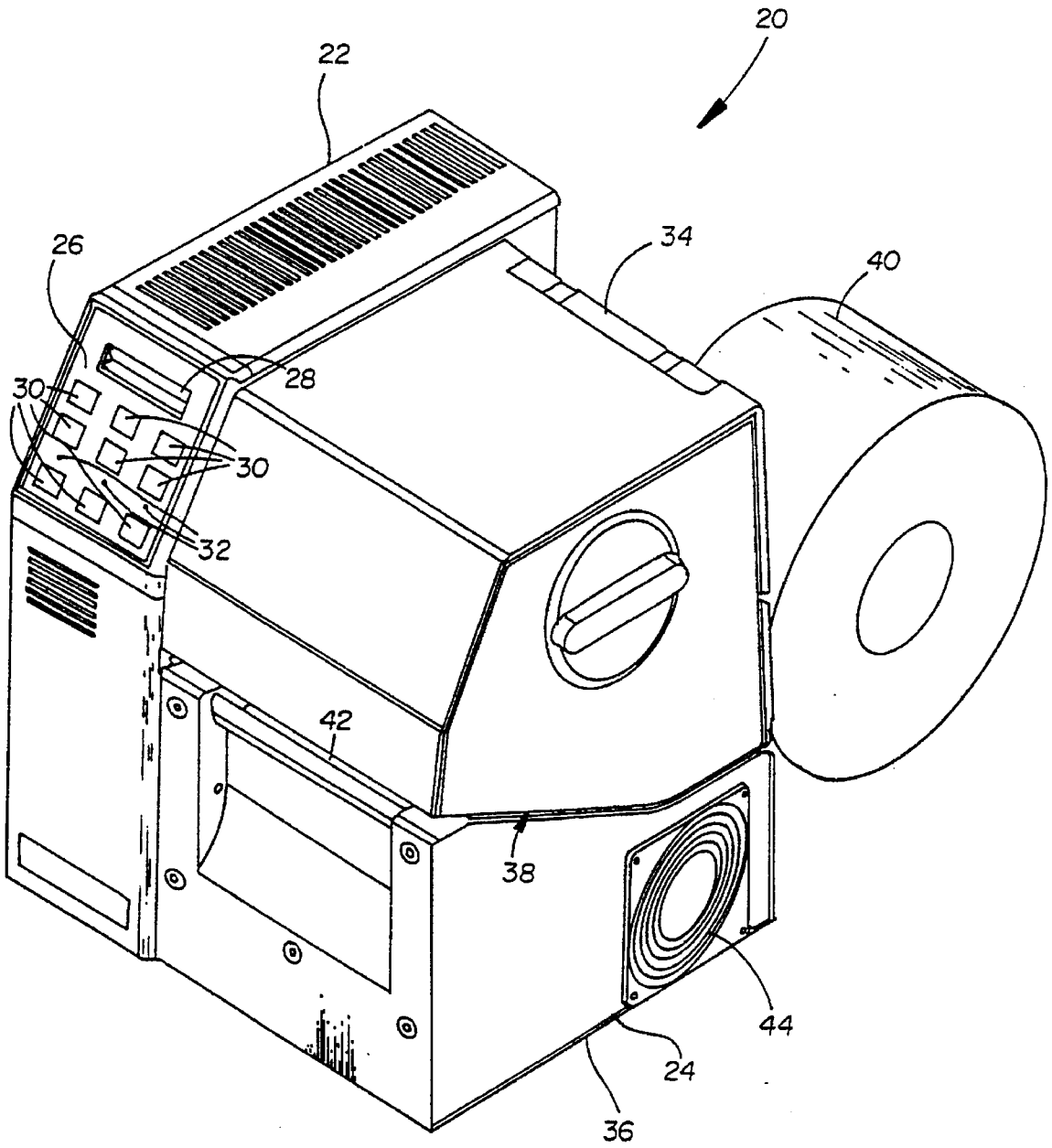
FIG. 1 is a perspective view of a thermal printer.

FIG. 1 is a perspective view of a thermal printer. The thermal printer 20 includes a first housing 22 and a second housing 24. The first housing 22 encloses electrical components, such as electrical motors used in the operation of the thermal printer 20. The first housing 22 also includes a control panel 26 which allows the thermal printer 20 to be controlled and adjusted by a user.

The control panel 26 includes a liquid crystal display (LCD) 28, a plurality of buttons 30, and a plurality of light emitting diodes (LEDs) 32. The LCD 28 provides an alphanumeric display of various commands useful for the user to control and adjust the thermal printer 20. The buttons 30 implement the user's choices of controls and adjustments, and the LEDs 32 provide displays of the status of the thermal printer 20. For example, one of the buttons 30 can be used to toggle the thermal printer 20 on- and off-line, with one of the LEDs 32 indicating when the printer is on-line. Another one of the buttons 30 can be used to select an array of menus that can be displayed in the LCD 28. These means can include choices of print speeds and media types, among other choices. Still another one of the buttons 30 can be used to reload or advance the print medium through the thermal printer 20. Yet another button 30 can be used to open the printer in order to change the print medium.

The second housing 24 contains a printer module 34 and a motor drive module 36 which are normally latched together. The printer module 34 and the motor drive module 36 are separated by a print medium path 38. By activating another one of the buttons 30, the printer module 34 can be caused to unlatch from the motor drive module 36 and rotate backwards, in a clockwise direction as seen in the view of FIG. 1. This action opens the print medium path 38 and allows the adjustment and replacement of the print medium which is introduced into the print medium path 38 from the print medium roll 40. The print medium supplied on the print medium roll 40 is available in a variety of thicknesses, thermal sensitivities, and materials, depending upon the use to be made of the print medium. The print medium supplied from the print medium roll 40 passes through the print medium path 38 and exits through the opening 42. If the print medium is a thermal transfer medium, a thermal transfer ribbon could be placed in a separate drive mechanism contained within the printer module 34. This separate drive mechanism provides supply and take-up rolls for the thermal transfer ribbon, the rolls being separately controllable from the movement of the print medium. This permits saving the thermal transfer ribbon when the pattern to be printed on the print medium contains areas where no printing is required. The motor drive module 36 also contains a cooling fan (not shown) which exhausts air through the grill 44.

Figure 2:
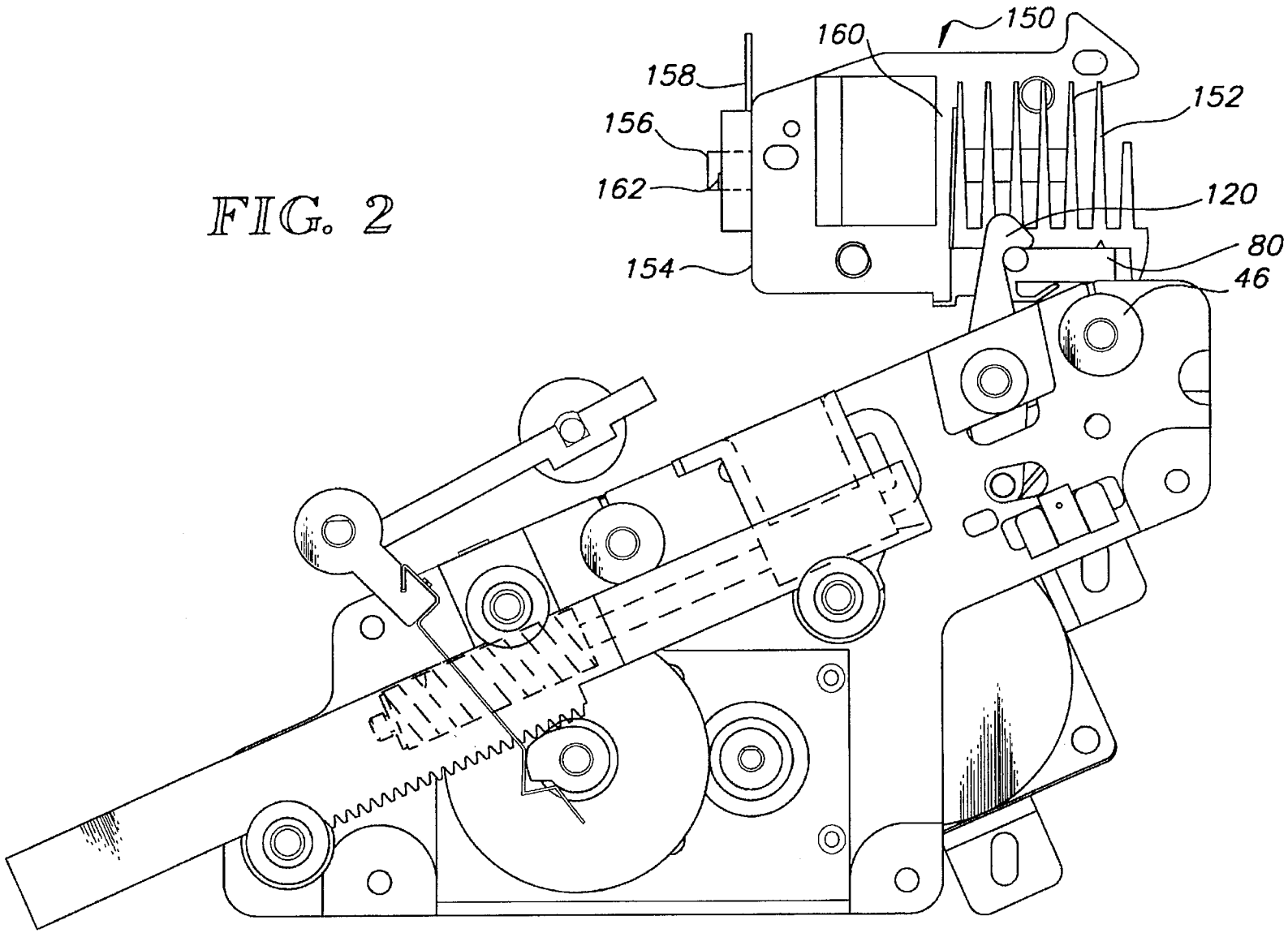
FIG. 2 is an elevational view of a headlift mechanism of the thermal printer of FIG. 1.

FIG. 2 is an elevational view of a headlift mechanism of the thermal printer of FIG. 1 and contained within the second housing 24. The printhead pressure mechanism is in a "print" mode.

The printhead pressure mechanism includes a platen roller 46 placed near the position of the opening 42, shown in FIG. 1. The print medium from the print medium roll 40 passes through the print medium path 38 with its printed side facing up. The print medium is advanced through the print medium path 38 by an advancement mechanism and forced to pass between the platen roller 46 and a thermal printhead 80 which is located near the opening 42. The platen roller 46 is a print medium support member that supports the print medium in the vicinity of the printhead 80, and the print medium is in constant contact with the printhead 80 when the printhead 80 is printing on the print medium.

When the printer module 34 is locked in position against the motor drive module 36, the print medium is forced against the printhead 80 by the platen roller 46. In order to accommodate a wide variety of printer media and to assure the uniformity of the printing formed on the print medium by the printhead 80, the force of the printhead 80 against the platen roller 46 is variably adjustable.

The printhead pressure mechanism also includes a printhead adjustment mechanism 150 which includes the printhead 80, a heat sink 152, and a printhead support member 154. The printhead adjustment mechanism 150 also includes a shaft 156 and a camming mechanism 158. The printhead 80 is attached to the heat sink 152 and a first end of the shaft 156 is attached to the heat sink 152 in a manner to be described in greater detail subsequently. The shaft 156 passes through the printhead support member 154 and a second end of the shaft 156 also passes through the camming mechanism 158. The printhead support member 154 is attached to the printer module 34 (see FIG. 1), and can be moved into position relative to the platen roller 46 and held in fixed position when the printer module 34 and the motor drive module 36 are latched together.

The printhead pressure mechanism further includes a biasing member 160 and a fastener or clip 162. The biasing member 160 could be made from plastics such as closed cell polyurethane foam (for example, Poron-TM) or acetal polymers, or from metals, such as a bowed washer made from stainless steel, spring steel, or beryllium copper. The biasing member 160 is placed between the heat sink 152 and the printhead support member 154. The clip 162 attached near the second end of the shaft 156 and serves to keep the camming mechanism 158 in place on the shaft 156.

Figure 3:
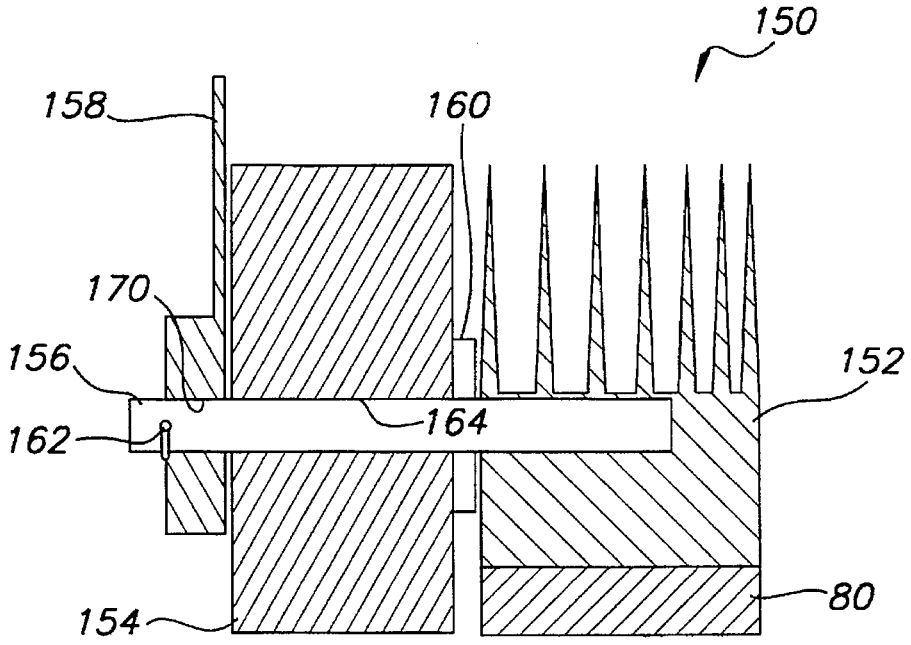
FIG. 3 is a cross-sectional view of a first embodiment of the printhead adjustment mechanism of the present invention, taken in the plane of FIG. 1 through the center of the printhead adjustment mechanism.

FIG. 3 is a cross-sectional view of a first embodiment of the printhead adjustment mechanism 150 of the present invention, taken in the plane of FIG. 1 through the center of the printhead adjustment mechanism 150. Parts of the printhead adjustment mechanism 150 which have already been described are given the same reference numbers as are used in the previous description. The first end of the shaft 156 is press-fit into the heat sink 152 and extends through a hole 164 placed through the printhead support member 154.

Figure 4:
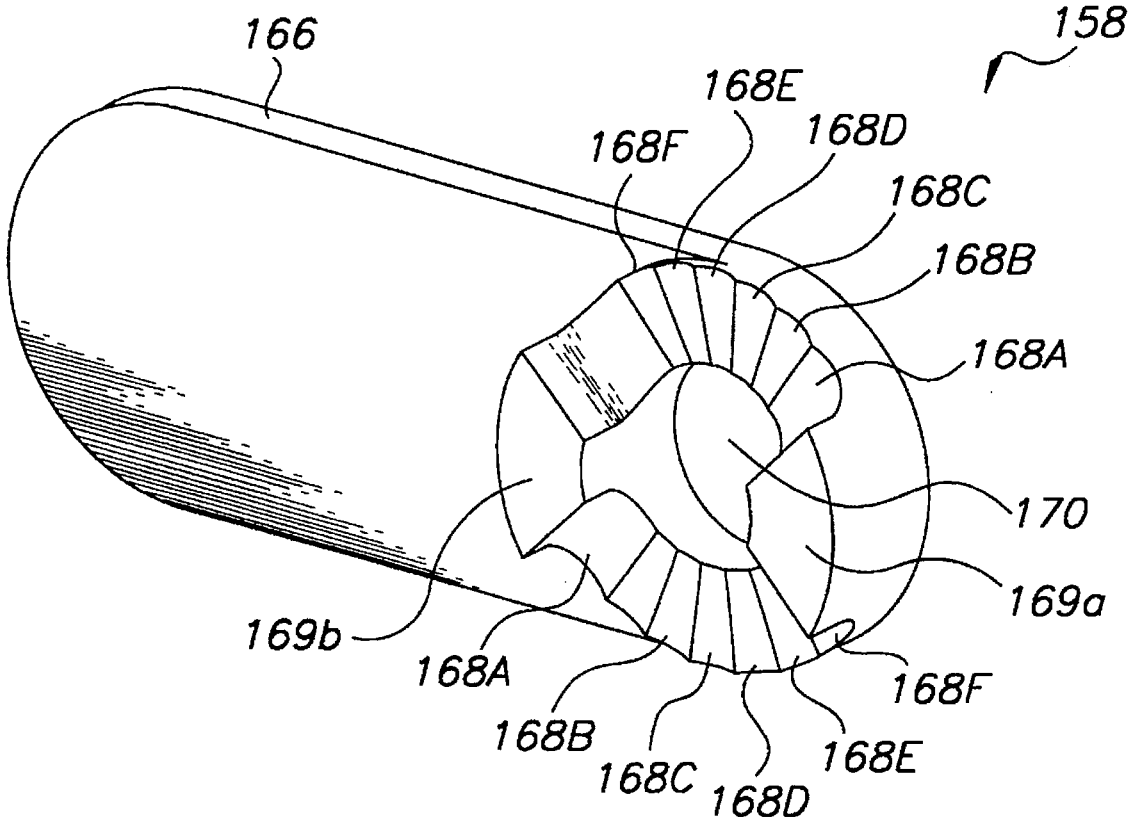
FIG. 4 is a perspective view of a camming mechanism for use in the first embodiment of the printhead adjustment mechanism of the present invention.

FIG. 4 is a perspective view of a camming mechanism for use in the first embodiment of the printhead adjustment mechanism of the present invention. The camming mechanism 158 includes a handle 166 and a series of pairs of wedging surfaces **168*a–f* which are diametrically opposed across a circular hole 170 formed in the camming mechanism 158. The camming mechanism 158 also includes elevated portions 169*a* and 169*b* which serve as rotational travel limits to the movement of the camming mechanism 158. The wedging surfaces 168*a–f* have different thicknesses in the direction of the hole 170 through the camming mechanism 158**.

The wedging surfaces **168*a–f* can take the form of detents. Detents provide precisely adjustable steps, visual and tactile feedback as the adjustment mechanism is being used to make an adjustment, and speed of adjustment. The detents in the wedging surfaces 168*a–f* can be arranged such that the handle 166 is vertical when the print head 80 is in a nominal position, such as a position that is between the optimium position for direct thermal and thermal transfer printing. Therefore it will be obvious to the user when the printhead 80** is adjusted away from the nominal position.

It is particularly convenient for the wedging surfaces **168*a–f* to be spaced uniformly in angle, for example, every 15 degrees. It is also convenient to place labelling of the handle 166 which indicates the step size (or sizes) which a particular camming mechanism 158** is capable of.

When the camming mechanism 158 is placed on the shaft 156, the thicknesses of the wedging surfaces 168*a–f* are aligned in the longitudinal direction of the shaft 156. In use, the camming mechanism 158 is adjusted by rotating it about the shaft 156. The clip 162 acts against one of the pairs of wedging surfaces 168*a–f*. Although the preferred embodiment has a clip 162 attached to the shaft 156, so as to act against the wedging surfaces 168*a–f*, the shaft may be configured with the second end of the shaft bearing against the selected wedging surfaces. The camming mechanism 158, in an alternate configuration similar to that shown in FIG. 5, has the wedging surfaces 168*a–f* arranged so as to act against a portion of the printhead support member 154 rather than the end of the shaft 156. Accordingly, the wedging surfaces 168*a–f* of the camming mechanism 158 act either against, as an example, the second end of the shaft 156 or the printhead support member 154 to control the position of the printhead 80 relative to the platen roller 46. Depending upon the longitudinal thickness of the particular pair of wedging surfaces 168*a–f* which are interacting with the clip 162, the camming mechanism causes a greater or lesser time to elapse between the time that a particular piece of the print medium passes under the printhead 80 and the time that the piece of the print medium is forced against the printhead support member 154. The movement caused by changing from one of the pairs of the wedging surfaces 168*a–f* to another is absorbed by the biasing member 160 and the printhead 80 is caused to move with respect to the printhead support member 154 in response to the force. If the wedging surfaces 168*a–f* are formed as detents, the adjustment of the camming mechanism 158 is not likely to change unless adjusted by an operator of the printer. The angular position of the handle 166 with respect to the shaft 156 is indicative of the adjustment of the printhead adjustment mechanism.

Figure 5:
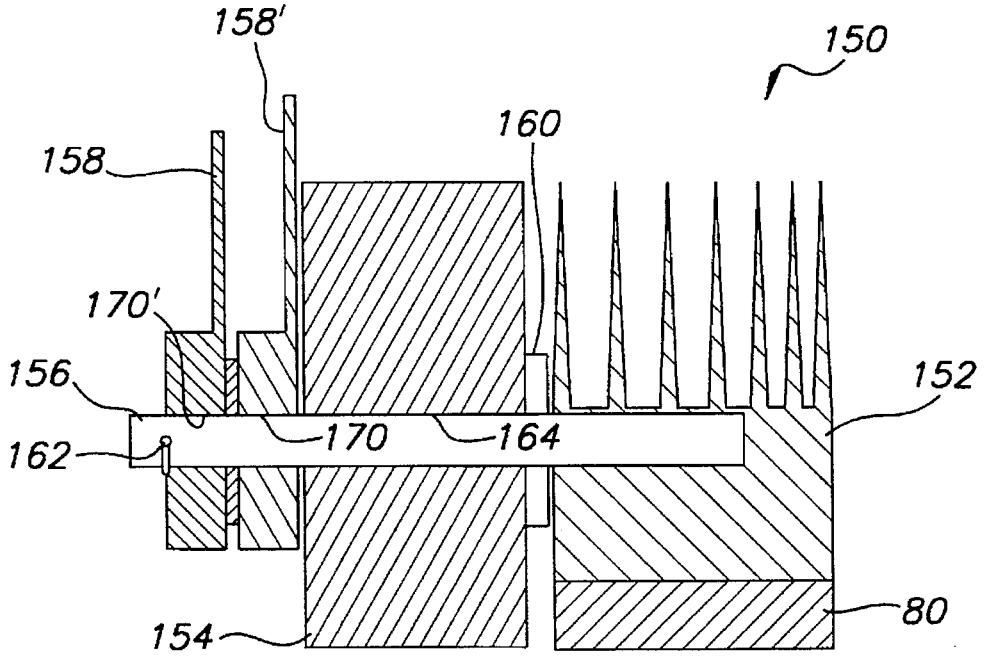
FIG. 5 is a cross-sectional view of a second embodiment of the printhead adjustment mechanism of the present invention, taken in the plane of FIG. 1 through the center of the printhead adjustment mechanism.

FIG. 5 is a cross-sectional view of a second embodiment of the printhead adjustment mechanism of the present invention, taken in the plane of FIG. 1 through the center of the printhead adjustment mechanism. Where appropriate, the reference numbers are identical to those already used. In this case the printhead adjustment mechanism has two camming mechanisms, camming mechanism 158 and camming mechanism 158'. The two camming mechanisms operate similarly to the single camming mechanism 158, as described previously, but they interact in a way which is best shown in FIG. 6.

Figure 6:
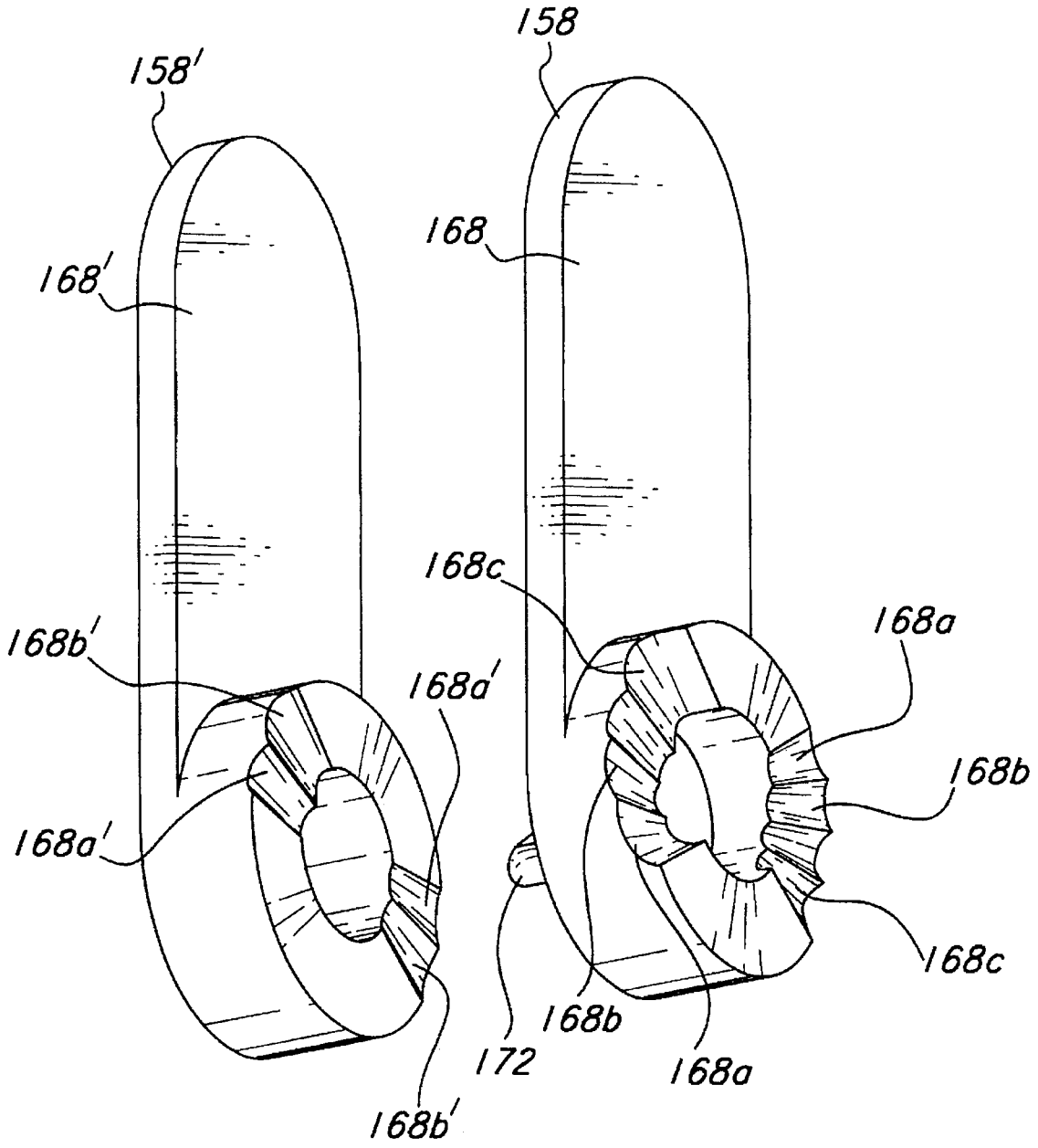
FIG. 6 is a perspective view of a camming mechanism for use in the second embodiment of the printhead adjustment mechanism of the present invention.

FIG. 6 is a perspective view of a camming mechanism for use in the second embodiment of the printhead adjustment mechanism of the present invention. In this embodiment the camming mechanism 158 also includes a projection 172 which extends toward and interacts with a selected one of the camming surfaces 168*a'* or 168*b'*. If the longitudinal thicknesses of the camming surfaces 168*a'* and 168*b'* on the camming mechanism 158' are made smaller than the thicknesses of the camming surfaces 168*a–c* on the camming mechanism 158, the camming mechanism 158' can be used as a fine adjustment of the position of printhead 80 and the camming mechanism 158 can be used as a coarse adjustment of the position of the printhead 80. In one embodiment, the two camming mechanisms 158 and 158' attach to the shaft 156 with the wedge surfaces 168*a–c* acting against the end of the shaft, and the wedge surfaces 168*a'–b'* acting against the projection 172 to obtain the fine position adjustment. In an alternate embodiment, the two camming mechanisms 158 and 158' attach to the shaft 156 such that the wedge surfaces 168*a–c* act against the printhead support member 154 with the wedging surfaces 168*a'–b'* acting against the projection 172. In yet another embodiment, the camming mechanism 158' is connected to the shaft 156 such that the wedging surfaces 168*a'–b'* bear against either the bearing surface of the printhead support member 154 or the end of the shaft, as discussed above. If the clip 162 is attached to the end of the shaft 156, the wedging surfaces 168*a'–b'* can bear against the clip. Thus, the camming mechanisms 158 anti 158' can be adjusted in predetermined, discrete amounts depending upon which of the wedging surfaces 168*a–c* and 168*a'–b'* engage the bearing surface of the clip 162, the bearing surface of the projection 172, or the bearing surface of the printhead support member 154.

As indicated above, a detailed illustrative embodiment is disclosed herein. However, other embodiments, which may be detailed rather differently from the disclosed embodiments, are possible. Consequently, the specific structural and functional details disclosed herein are merely representative: yet in that regard, they are deemed to afford the best embodiments for the purposes of disclosure and to provide a basis for the claims herein, which define the scope of the present invention.

I claim:

1. An adjustment mechanism for a printhead that prints on a print medium that passes between the printhead and a print medium support member, comprising:

a printhead support member releasably retained in a fixed position relative to the print medium support member, the printhead support member movably supporting the printhead in a selectable position relative to the printhead support member and the print medium support member;

a biasing member attached to the printhead support member, the biasing member producing a biasing force on the printhead support member for biasing the printhead away from the printhead support member and toward the selectable position; and an adjusting device acting upon the printhead support member and the biasing member, the adjusting device being adapted to adjustably move the printhead along a path that is tangential to the print medium support member to the selectable position relative to the printhead support member and the print medium support member to achieve a selected print quality.

2. The adjustment mechanism of claim 1 wherein the biasing member is made of a pliable plastic material.

3. The adjustment mechanism of claim 1 wherein the adjusting device includes a plurality of discrete steps of predetermined sizes for adjusting the selectable position of the printhead in predetermined discrete amounts.

4. The adjustment mechanism of claim 3 wherein the adjusting device further includes a first plurality of wedging surfaces.

5. The adjustment mechanism of claim 4 wherein the adjusting device includes an engaging member coupled to the first plurality of wedging surfaces, and the adjusting device further includes a second plurality of wedging surfaces that can be selected to independently bear against the engaging member.

6. The adjustment mechanism of claim 1 wherein the adjusting device includes an indicator to indicate a selected amount of adjustment of said selectable position of the printhead.

7. An adjustment mechanism for a printhead that prints on a print medium that passes between the printhead and a print medium support member that supports the print medium adjacent to the printhead, comprising:

a printhead support member releasably retained in a fixed position relative to the print medium support member;

a shaft passing through the printhead support member, the shaft having a first end and a second end arranged in a longitudinal direction, a longitudinal position of the first end of the shaft relative to the printhead support member being adjustable;

a cam mechanism placed between the first end of the shaft and the printhead support member for adjusting a selected distance between the first end of the shaft and the printhead support member;

a printhead heat sink attached to the second end of the shaft, the printhead being attached to the printhead heat sink for movement therewith along a path that is tangential to the print medium support member; and a biasing member placed along the shaft between the printhead support member and the printhead heat sink and in contact with both the printhead support member and the printhead heat sink and biasing the printhead heat sink away from the printhead support member with a variable biasing force.

8. The adjustment mechanism of claim 7 wherein the biasing member is an annular washer made of a pliable plastic material and placed around the shaft.

9. The adjustment mechanism of claim 7 wherein the cam mechanism further includes a first plurality of wedging surfaces that bear against at least one of the first end of the shaft and the printhead support member.

10. The adjustment mechanism of claim 9 wherein, when the first plurality of wedging surfaces bears against exactly one of the first end of the shaft or the printhead support member, the cam mechanism further includes an engaging member opposite the first plurality of wedging surfaces and a second plurality of wedging surfaces that can be selected to independently bear against the engaging member.

11. The adjustment mechanism of claim 7 wherein the cam mechanism includes a first lever that rotates around the shaft in a plane that is perpendicular to the longitudinal direction of the shaft and a fastener attached at or near the first end of the shaft, the first lever having a first plurality of features having discrete predetermined thicknesses in the longitudinal direction and the fastener having a bearing surface for engagement with any selected one of the first plurality of features, whereby the position of the printhead is adjusted along the longitudinal direction of the shaft in predetermined discrete amounts depending upon which of the first plurality of features is engaged with the bearing surface of the fastener.

12. The adjustment mechanism of claim 11 wherein the shaft further includes a feature formed on the first end of the shaft and the fastener is attached to the feature.

13. The adjustment mechanism of claim 12 wherein the feature is a hole formed transversely to the longitudinal direction and near the first end of the shaft and the fastener includes a pin that passes through the hold, a surface of the pin being the bearing surface that engages with any selected one of the first plurality of features on the first lever.

14. The adjustment mechanism of claim 13 wherein the first plurality of features on the first lever are detent surfaces.

15. The adjustment mechanism of claim 11 wherein an angular position of rotation of the first lever with respect to the shaft indicates the selected one of the first plurality of features.

16. The adjustment mechanism of claim 11 wherein the cam mechanism further includes a second lever that rotates around the shaft in a plane that is perpendicular to the longitudinal direction of the shaft, the second lever having a second plurality of features having discrete predetermined thicknesses in the longitudinal direction and one of the first lever, the first end of the shaft, or the fastener having a bearing surface for engagement with any selected one of the second plurality of features, whereby the position of the printhead is adjusted along the longitudinal direction of the shaft in predetermined discrete amounts depending upon which of the first plurality of features and which of the second plurality of features is engaged with the printhead support member, the first lever, or the bearing surface of the fastener.

17. A thermal printer having a thermal printhead for printing on a thermally sensitive print medium, comprising:

a mechanism for furnishing a supply of the thermally sensitive print medium;

a print medium support member that supports the print medium adjacent to the printhead;

a mechanism for advancing the thermally sensitive print medium between the printhead and the print medium support member;

a printhead support member releasably retained in a fixed position relative to the print medium support member;

a biasing member attached to the printhead support member and coupled to the printhead, the biasing member being adapted to produce a biasing force for biasing the printhead away from the printhead support member; and a cam mechanism operatively engaging the biasing member and the printhead, the cam mechanism acting on the printhead support member to selectively adjust the position of the printhead along a path that is tangential to the print medium support member relative to the printhead support member and the print medium support member to achieve a selected print quality.

18. The thermal printer of claim 17 wherein the biasing member is an annular washer made of a pliable plastic material and placed around a shaft.

19. The thermal printer of claim 17 wherein the cam mechanism includes a first lever that rotates around a shaft, the shaft having a first end and a second end arranged in a longitudinal direction, a longitudinal position of the first end of the shaft being adjustable in the longitudinal direction of the shaft relative to the printhead support member, the first lever being rotatable in a plane perpendicular to the longitudinal direction, and a fastener is attached at or near the first end of the shaft, the first lever having a plurality of features having discrete predetermined thicknesses in the longitudinal direction and the fastener having a bearing surface for engagement with any selected one of the plurality of features, whereby the position of the printhead relative to the printhead support member is adjusted in predetermined discrete amounts depending upon which of the plurality of features is engaged with the bearing surface of the fastener.

20. The thermal printer of claim 19 wherein the shaft further includes a hole formed near the first end of the shaft and the fastener disposed in the hole, the hole being formed transversely to the longitudinal direction and the fastener including a pin that passes through the hole, a surface of the pin being the bearing surface that engages with any selected one of the plurality of features on the first lever.

21. The thermal printer of claim 20 wherein the plurality of features on the first lever are detent surfaces.

22. The adjustment mechanism of claim 19 wherein the cam mechanism further includes a second lever that rotates around the shaft in a plane that is perpendicular to the longitudinal direction of the shaft, the second lever having a second plurality of features having discrete predetermined thicknesses in the longitudinal direction and one of the first lever, the first end of the shaft, or the fastener having a bearing surface for engagement with any selected one of the second plurality of features, whereby the position of the printhead is adjusted in predetermined discrete amounts depending upon which of the plurality of features on the first lever and which of the second plurality of features is engaged with the printhead support member, the first lever, or the bearing surface of the fastener.

23. A method for adjusting a printhead that prints on a print medium that passes between the printhead and a print medium support member, comprising the steps of:

placing a printhead support member in a fixed position relative to the print medium support member;

producing a variable biasing force on the printhead away from the printhead support member and toward the print medium support member; and adjusting with a selectively operable camming mechanism coupled to the printhead and the printhead support member the position of the printhead relative to the printhead support member and relative to the print medium support member and along a path that is tangential to the print medium support member to control print quality from the printhead to the print medium.

24. A method for making adjustments to a selected position of a thermal printhead in a thermal printer having a thermal printhead and a print medium support member, the position of the thermal printhead being along a path that is tangential to the print medium support member, the method comprising the steps of:

providing a single indexing marker having sequential adjustment points on an adjustment means that is connected to the printhead, the adjustment points corresponding to positions of the printhead along the path that is tangential to the print medium support member;

adjusting the adjustment means relative to the printhead and moving the printhead along the path; and indicating with the indexing marker an adjustment point that indicates to a user the position of the printhead of the thermal printer.

* * * * *